US007258597B2

(12) United States Patent
Benson

(10) Patent No.: US 7,258,597 B2
(45) Date of Patent: Aug. 21, 2007

(54) SUBSEA ABRASIVE JET CUTTING SYSTEM AND METHOD OF USE

(75) Inventor: Dan Thomas Benson, Tomball, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 11/270,677

(22) Filed: Nov. 9, 2005

(65) Prior Publication Data

US 2007/0105486 A1 May 10, 2007

(51) Int. Cl.
*B24C 7/00* (2006.01)

(52) U.S. Cl. ..... 451/40; 451/99

(58) Field of Classification Search ..... 451/38, 451/39, 40, 90, 75, 99
See application file for complete search history.

(56) References Cited

U.S. PATENT DOCUMENTS 3,256,642 A * 6/1966 Fonti ..... 451/90
3,323,257 A * 6/1967 Fonti ..... 451/75
4,555,872 A * 12/1985 Yie ..... 451/40
4,856,938 A 8/1989 Kuehn
5,505,639 A 4/1996 Burg
6,168,503 B1 1/2001 Pao et al.
6,283,833 B1 9/2001 Pao et al.

FOREIGN PATENT DOCUMENTS

GB 2045658 * 11/1980 ..... 451/40
GB 2249045 * 4/1992 ..... 451/75
JP 63-162159 * 7/1988 ..... 451/38
JP 3-245970 * 11/1991 ..... 451/90

* cited by examiner

*Primary Examiner*—Robert A. Rose
(74) *Attorney, Agent, or Firm*—Duane Morris LLP

(57) ABSTRACT

An apparatus for cutting a material underwater is disclosed where the apparatus uses a mixture of abrasive material in a non-aspirated suspension mixed with a high pressure fluid, e.g. seawater. It is emphasized that. this abstract is provided to comply with the rules requiring an abstract which will allow a searcher or other reader to quickly ascertain the subject matter of the technical disclosure. It is submitted with the understanding that it will not be used to interpret or limit the scope of meaning of the claims.

16 Claims, 2 Drawing Sheets

SUBSEA ABRASIVE JET CUTTING SYSTEM AND METHOD OF USE

FIELD OF THE INVENTION

The present invention relates to subsea cutting systems. More specifically, the present inventions relate to a system and method of use of a system for cutting a material subsea using a source of high pressure fluid, a source of abrasive materials where abrasive materials are present in non-aspirated suspension, and body in fluid communication with both.

BACKGROUND OF THE INVENTION

Abrasive materials in cutting systems have been used to aid in rough and precision cuts. A basic cutting system consists of a filtration system, ultrahigh-pressure pump, nozzle and catcher. A hydraulically driven intensifier pump may be present to pressurize a fluid such as water where the fluid exits through an orifice, e.g. a nozzle, for cutting a material. Abrasive material is typically mixed with the fluid by aspiration, e.g. a cutting head of the nozzle operates pneumatically such that when the cutting system is activated, abrasive is mixed with fluid under pressure and the mixture flows into the cutting head.

Abrasives may further be found in the prior art mixed in with another substance such as a gel, e.g. as a colloidal or emulsified mixture.

A problem exists when attempting to use abrasive cutting systems underwater, especially at great depths. A supply system is typically located at the surface of the water and fluid, abrasives, or both are supplied via an umbilical. Prior art systems are unsuited for use at depths because of the air or other gas supply typically required to aspirate the mixture for use in cutting.

BRIEF DESCRIPTION OF THE DRAWINGS

The features, aspects, and advantages of the present invention will become more fully apparent from the following description, appended claims, and accompanying drawings in which:

DETAILED DESCRIPTION OF AN EXEMPLARY EMBODIMENT

Figure 1:
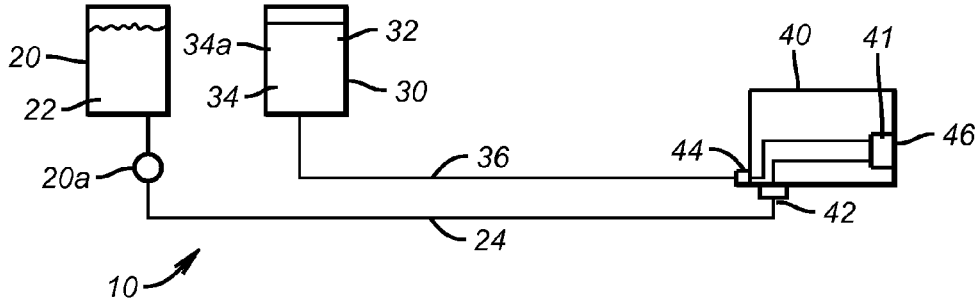
FIG. 1 is a schematic of first exemplary embodiment of the system.

Referring to FIG. 1, system 10 is useful for cutting a material underwater. In a preferred embodiment, system 10 comprises source 20 of high pressure fluid 22, source 30 of abrasive materials 32 where abrasive materials 32 are present in non-aspirated suspension 34, and body 40.

In a preferred embodiment, high pressure fluid 22 is water, e.g. sea water, brought to high pressure from source 20 such as pump 20*a*. In certain embodiments, system 10 further comprises hose 24 which connects source 20 to body 40.

Source 30 of abrasive materials 32 may comprise any appropriate abrasive material such as garnet, bauxite, sand, or taconite or the like or a combination thereof. Hose 36 may connect source 30 to body 40.

In a preferred embodiment, suspension 34 comprises non-aspirated aqueous gel 34*a*, preferably gelled to between 40000 and 50000 cp. Aqueous gel 34*a* may comprise guar gum, xanthan gum, methylcellulose, or the like, or a combination thereof.

In a further preferred embodiment, suspension 34 further comprises a grit-like substance of a predetermined granularity mixed into aqueous gel 34*a* in a predetermined ratio, e.g. 80 grit garnet mixed by volume in aqueous gel 34*a* in a one part 80 grit garnet to one-and-a-half ratio part gel 34*a* ratio.

Body 40 may be manipulatable by a remotely operated vehicle ("ROV"). In a currently preferred embodiment, body 40 further comprises first inlet 42 fluidly coupled to source 20 of high pressure fluid 22 to accept high pressure fluid 22, e.g. first inlet 42 may be fluidly coupled to source 20 via hose 24.

Body 40 may further comprise second inlet 44 fluidly and non-aspiratedly coupled to source 30 of abrasive materials 32 in suspension 34, e.g. via hose 36.

Cutting nozzle 46 is disposed within or about body 40 and is in fluid communication with both first inlet 42 and second inlet 44.

Figure 2:
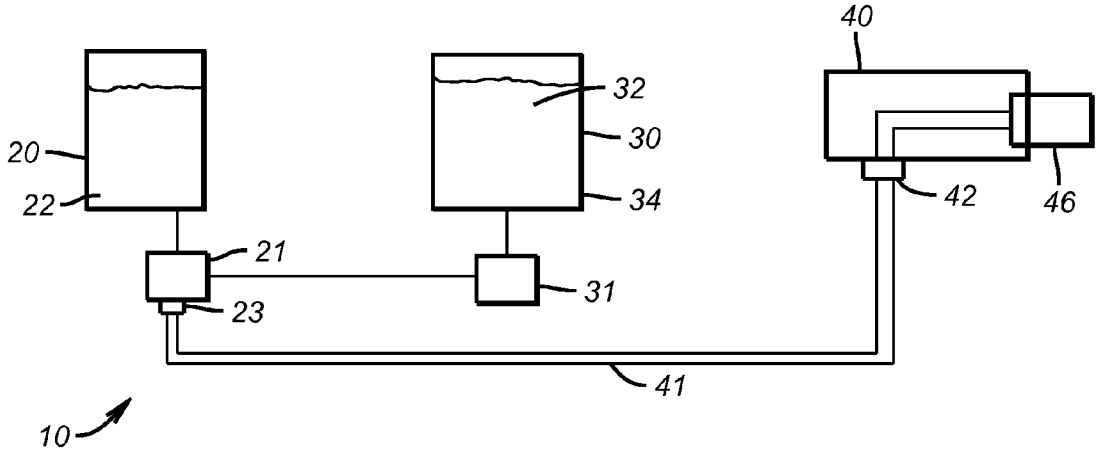
FIG. 2 is a schematic of second exemplary embodiment of the system.

In a currently envisioned alternative embodiment, referring now to FIG. 2, system 10 comprises source 30 of abrasive materials 32 in suspension 34; first pump 31 in fluid communication with source 30; second pump 21 in fluid communication with first pump 31 and in further fluid communication with fluid 22; and body 40.

Second pump 21 is capable of creating a pressurized mix of abrasive materials 32, which are preferably mixed or otherwise suspended in suspension 34, with fluid 22. Second pump 21 further comprises outlet 23 for pressurized mixture 41.

Body 40 further comprises first inlet 42 fluidly coupled to outlet 23 to accept pressurized mixture 41 and cutting nozzle 46 which is in fluid communication with pressurized mixture 41. As with the first described embodiment, body 40 may be manipulatable by an ROV.

Figure 3:
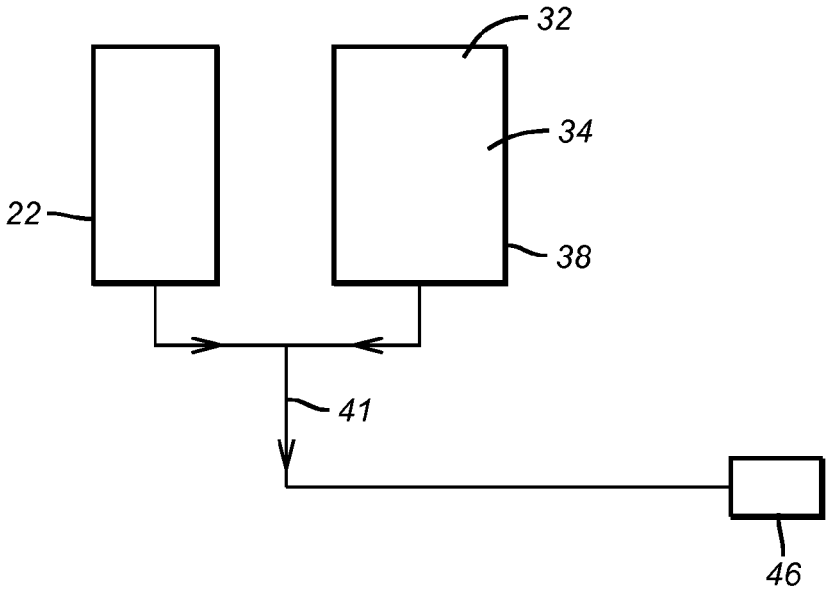
FIG. 3 is a schematic of an exemplary method of the present invention.

In the operation of an exemplary embodiment, referring now to FIG. 3, first fluid 22 is mixed with second fluid 38 that further comprises abrasive materials 32 in a non-aspirated suspension 34 to create mixture 41. Mixture 41, comprising a wet abrasive, is then pressurized and delivered to cutting nozzle 46 underwater.

In an alternative method of use, mixture 41 (FIG. 1) is delivered to cutting nozzle 46 (FIG. 1) underwater by pressuring abrasive materials 32 (FIG. 1) in non-aspirated suspension 34 (FIG. 1); pressurizing fluid 22 (FIG. 1); and providing pressurized abrasive materials 32 in non-aspirated suspension and pressurized fluid 22 to cutting nozzle 46 underwater.

Figure 4:
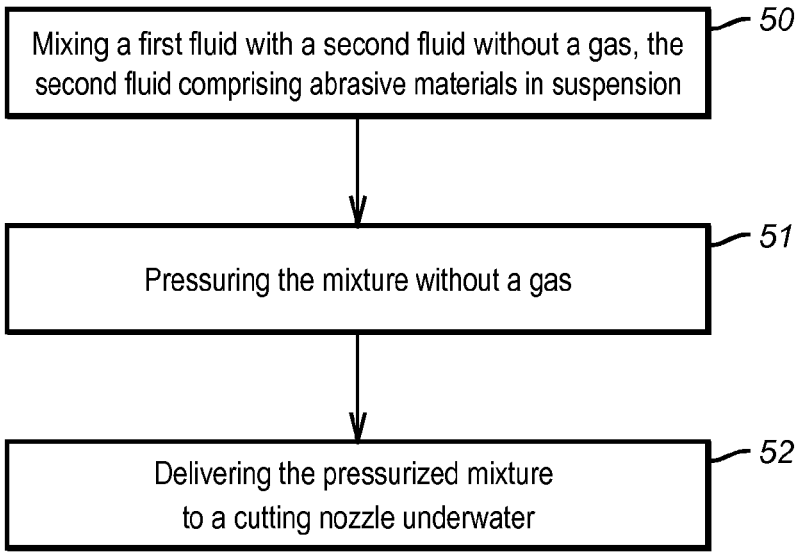
FIG. 4 is a flowchart of and exemplary method of the present invention.

An alternate method of delivering a wet abrasive to a cutting nozzle underwater is illustrated by the flowchart of FIG. 4. One step involves the mixing a first fluid with a second fluid without a gas 50, wherein the second fluid comprises an abrasive materials in a suspension. Next the mixture is pressured without a gas 51. Finally, the pressurized mixture is delivered to a cutting nozzle underwater 52.

It will be understood that various changes in the details, materials, and arrangements of the parts which have been described and illustrated above in order to explain the nature of this invention may be made by those skilled in the art without departing from the principle and scope of the invention as recited in the following claims.

I claim:

1. A system for cutting a material underwater, comprising:

b. a source of abrasive materials in a suspension;

c. a first pump in fluid communication with the source of abrasive materials in the suspension;

d. a second pump in fluid communication with the first pump and in further fluid communication with a fluid, the second pump adapted to create a non-aspirated, pressurized mix of the abrasive materials in the suspension with the fluid, the second pump further comprising an outlet for the pressurized mix; and e. a body, further comprising:

i. a first inlet fluidly coupled to the outlet to accept the pressurized mix; and iii. a cutting head in fluid communication with the pressurized mix.

2. The system according to claim 1, wherein the fluid further comprises water.

3. The system according to claim 1, wherein the the first pump is a high pressure pump and the second pump is a high pressure pump.

4. The system according to claim 1, further comprising a hose in fluid communication between the second pump and the body.

5. The system according to claim 1, wherein the suspension comprises an aqueous gel.

6. The system according to claim 5, wherein the suspension is gelled to between 30000 and 60000 cp.

7. The system according to claim 5, wherein the aqueous gel comprises at least one of (i) guar gum, (ii) xanthan gum, or (iii) methylcellulose.

8. The system according to claim 1 wherein the abrasive material comprises at least one of (i) garnet, (ii) bauxite, (iii) sand, or (iv) taconite.

9. The system according to claim 1, wherein the suspension comprises 80 grit garnet mixed by volume in an aqueous gel in a one part 80 grit garnet to between a ration of around one part gel to around three parts gel.

10. The system according to claim 1, further comprising a hose in fluid communication between the source of abrasive materials in a suspension and the body.

11. The system according to claim 1, wherein the system is configured for displacement subsea without a need for a surface source of either high pressure fluid or abrasive material.

12. The system according to claim 1, wherein the body is adapted to be manipulated by a remotely operated vehicle.

13. A method of delivering a wet abrasive to a cutting nozzle underwater, comprising:

a. placing a first pump into fluid communication with a source of abrasive materials in a suspension;

b. placing a second pump into fluid communication with a fluid;

c. placing the second pump into fluid communication with the first pump, wherein the second pump is capable of creating a non-aspirated, pressurized mix of the abrasive materials in the suspension with the fluid, the second pump further comprising an outlet for the pressurized mix;

d. using the first pump and the second pump to mix the first fluid with a second fluid without a gas, the second fluid comprising abrasive materials in a suspension;

e. pressuring the mixture using the first pump and the second pump without a gas; and f. delivering the pressurized mixture to a cutting nozzle underwater.

14. A method of delivering a wet abrasive to a cutting nozzle underwater, comprising:

a. pressuring abrasive materials in a suspension without use of a gas using a first pump;

b. fluidly providing the pressurized abrasive materials to the second pump;

c. pressurizing a fluid mixed with the pressurized abrasive materials without use of a gas using a second pump; and d. providing the pressurized abrasive materials in a non-aspirated suspension and the pressurized fluid to a cuffing nozzle underwater.

15. The method of delivering a wet abrasive to a cutting nozzle underwater of claim 14, wherein the cutting nozzle is a single cutting nozzle.

16. The of claim 1 wherein the cutting head comprises a single cutting nozzle.

* * * * *

UNITED STATES PATENT AND TRADEMARK OFFICE

CERTIFICATE OF CORRECTION

PATENT NO. : 7,258,597 B2
APPLICATION NO. : 11/270677
DATED : August 21, 2007
INVENTOR(S) : Dan Thomas Benson It is certified that error appears in the above-identified patent and that said Letters Patent is hereby corrected as shown below:

Col. 3, line 3 replace “b.” with --a.--.
Col. 3, line 4 replace “c.” with --b.--.
Col. 3, line 6 replace “d.” with --c.--.
Col. 3, line 12 replace “e.” with --d.--.
Col. 3, line 15 replace “iii.” with --ii--.

Signed and Sealed this

Thirtieth Day of October, 2007

JON W. DUDAS
*Director of the United States Patent and Trademark Office*